US006308390B1

(12) United States Patent
Sullivan

(10) Patent No.: US 6,308,390 B1
(45) Date of Patent: Oct. 30, 2001

(54) DOOR HINGE PIN REMOVAL TOOL

(76) Inventor: Loy David Sullivan, 4814 Bowman St., LakeWorth, FL (US) 33463

( * ) Notice: Subject to any disclaimer, the term of this patent is extended or adjusted under 35 U.S.C. 154(b) by 0 days.

(21) Appl. No.: 09/713,088

(22) Filed: Nov. 15, 2000

(51) Int. Cl.[7] ..... B25B 27/14

(52) U.S. Cl. ..... 29/275; 29/278; 81/52.3; 254/25; 254/137

(58) Field of Search ..... 145/46; 254/131, 254/25; 29/275, 278, 253, 254, 255, 276, 280; 81/52.3, 52.35

(56) References Cited

U.S. PATENT DOCUMENTS

| | | | | |
|---|---|---|---|---|
| 716,274 | * | 12/1902 | Peirce | 29/275 |
| 2,089,902 | | 8/1937 | Kulp . | |
| 3,602,969 | | 9/1971 | Provost . | |
| 3,689,977 | | 9/1972 | Crabbe . | |
| 4,183,133 | | 1/1980 | Abbott . | |
| 4,188,701 | | 2/1980 | Ludwig . | |
| 4,432,125 | | 2/1984 | Monteleone et al. . | |
| 5,099,562 | | 3/1992 | Loughran . | |
| 5,438,743 | | 8/1995 | Simington et al. . | |
| 5,875,535 | | 3/1999 | Canoy . | |

FOREIGN PATENT DOCUMENTS

| | | | | |
|---|---|---|---|---|
| 2928670 | * | 2/1981 | (DE) | 29/275 |

* cited by examiner

*Primary Examiner*—Joseph J. Hail, III
*Assistant Examiner*—Daniel Shanley
(74) *Attorney, Agent, or Firm*—Stearns Weaver Miller Weissler Alhadeff & Sitterson PA

(57) ABSTRACT

A hand tool for use in removing a pintle from a door hinge, comprising a rigid, barrel with a slotted aperture enclosing a push rod affixed to a base adapted to thrust the pintle out of a door hinge when the tool is placed against the door hinge pintle and struck with a blunt object. A viewing window is defined by the barrel for providing proper visual alignment and placement of the push rod against the door hinge pintle. The base includes a notch for use in removing hinge pintle caps.

7 Claims, 1 Drawing Sheet

DOOR HINGE PIN REMOVAL TOOL

CROSS REFERENCE TO RELATED APPLICATIONS

N/A

STATEMENT REGARDING FEDERALLY SPONSORED RESEARCH OR DEVELOPMENT

NA

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office patent file or records, but otherwise reserves all copyrights rights whatsoever.

BACKGROUND OF THE INVENTION

1. Field of the Invention

The present invention relates generally to hand tools, and more particularly to a hand tool adapted for use in removing the pintle from a door hinge when the tool is placed against the door hinge pintle and struck with a blunt object.

2. Description of the Background Art

Several hand tools designed for use in removing a pintle from a door hinge are known in the background art. For instance, U.S. Pat. No. 2,089,902, issued to Kulp, discloses a valve driver for use in removing automobile valves without damage. U.S. Pat. No. 3,602,969, issued to Provost, discloses a hinge pintle removing tool, primarily designed for carpenters, adapted to loosen and remove a headed pintle from a door hinge. The device comprises a one-piece tool with a head, with a first portion adapted for prying and loosening the headed end of the pintle, and a second portion for engaging the pintle head, enabling the user to remove the pintle using a hammer. U.S. Pat. No. 3,689,977, issued to Crabbe, discloses a device for removing a hinge pin, particularly from a plate type hinge. The tool includes an end portion with a blade to assist in loosening the pin, and a shoulder portion to assist in removing the pin. The most similar patent to the present invention is U.S. Pat. No. 4,183,133, issued to Abbott. It discloses a hand tool adapted to remove a pintle from a door hinge, comprising of a curved hollow guide or shield within which is fixed a push rod adapted to force the pintle out of a door hinge when the tool is placed against the door hinge pintle and struck with a hammer. This tool, however, does not include a specially adapted end to assist in loosening the hinge pin, nor does it include a means for aiding in alignment of the tool when in use. U.S. Pat. No. 4,188,701, issued to Ludwig, discloses a tool having a wedge-shaped head mounted on a shank equipped with a support projection to receive the hinge. The head includes an impact surface for hammering the wedge portion between the hinge and the head of the hinge pin. U.S. Pat. No. 4,432,125, issued to Monteleone, et al., discloses a hinge pin removal tool mainly for removing automobile hinges with the aid of a pneumatic impact tool. U.S. Pat. No. 5,099,562, issued to Loughran discloses a hinge pin and tip removal tool having first and second portions of differing diameters. U.S. Pat. No. 5,438,743, issued to Simington, et al., discloses an apparatus for extracting and installing automobile hinge pins. U.S. Pat. No. 5,875,535, issued to Canoy, discloses a hinge pin removal tool for removing a head-capped pin from a knuckled door hinge.

The background art devices, however, are burdened with a number of significant disadvantages that have limited acceptance and use of said devices. One disadvantage present is that none of the devices allow the user of the hand tool to a line of site to aid in aligning the tool with the door hinge pintle when in use. As a result of said disadvantage, the user may require several attempts before successfully accomplishing the task of removing the door hinge pintle. This unnecessary burden can be time-consuming and frustrating and effectively rely on trail and error. Another disadvantage present in the devices of the background art is that said devices lack a means for self-alignment of the hand tool. Thus, there exists a need for such a hinge pin removal tool encompassing all of these elements.

BRIEF SUMMARY OF THE INVENTION

The present invention provides an improved door hinge pin removal tool that overcomes the disadvantages present in the devices of the background art. A door hinge removal tool according to the present invention includes a base having a projecting hollow barrel that substantially encloses a push rod that functions upon use to thrust a previously installed door hinge pintle from the hinge structure. The barrel defines a longitudinal slot that functions to allow the device to slide over the installed hinge and pin assembly, and a window that functions to allow the user to visually align the push rod with the bottom of the hinge pin. The base of the device includes a notch for use with hinges wherein the pintle is capped with a plug for removing the plug.

Accordingly, it is a primary object of the instant invention to provide an improved door hinge pin removal tool.

Still another object of the present invention is to provide a self-aligning door hinge pin removal tool.

Yet another object of the present invention is to provide a door hinge removal tool that provides the user with a visual alignment means.

Still another object of the present invention is to provide a door hinge removal tool that includes a notch for removing hinge pin caps.

Yet another object of the present invention is to provide a slotted barrel having a tapered end portion that facilitates the slidable engagement of the tool with the door hinge structure.

In accordance with these and other objects, which will become apparent hereinafter, the instant invention will now be described with particular reference to the accompanying drawings.

DETAILED DESCRIPTION OF THE INVENTION

Figure 1:
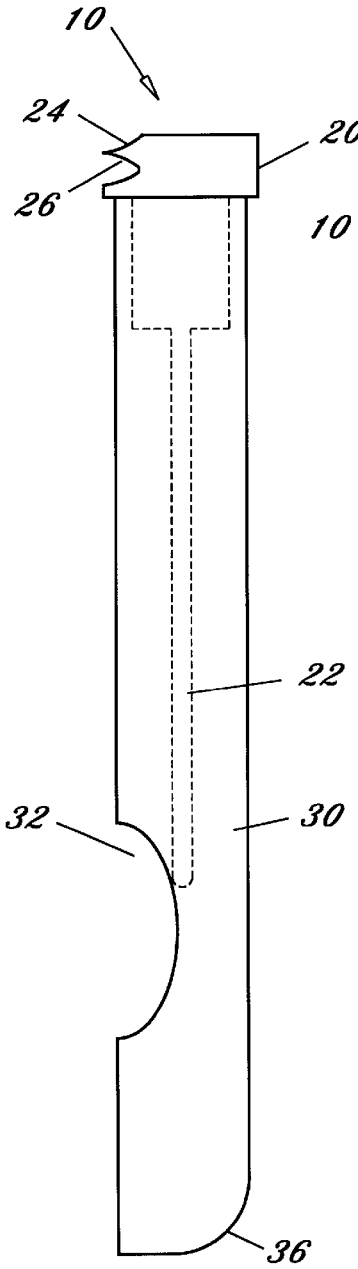
FIG. 1 is a side view of a door hinge removal tool according to the present invention.
Figure 2:
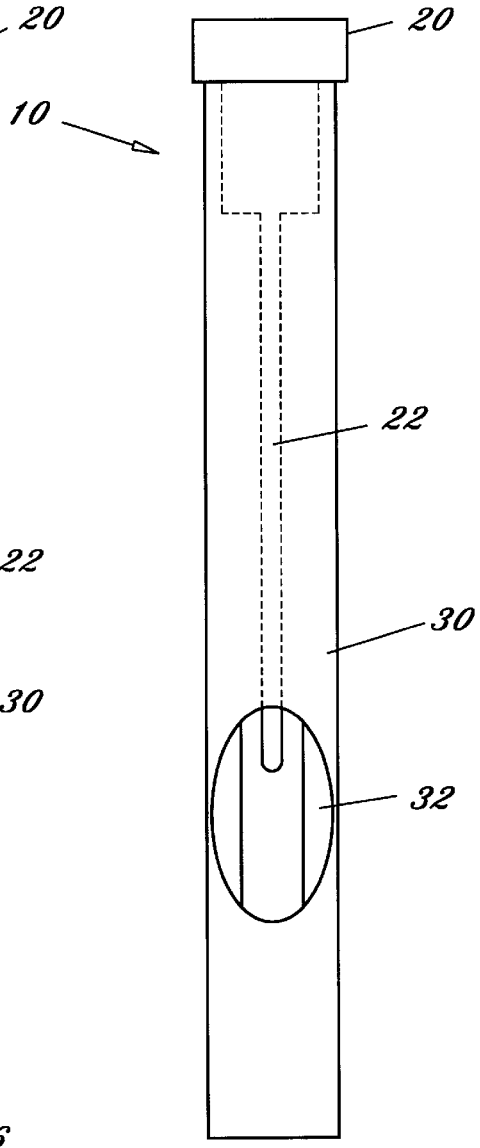
FIG. 2 is a front view thereof.
Figure 3:
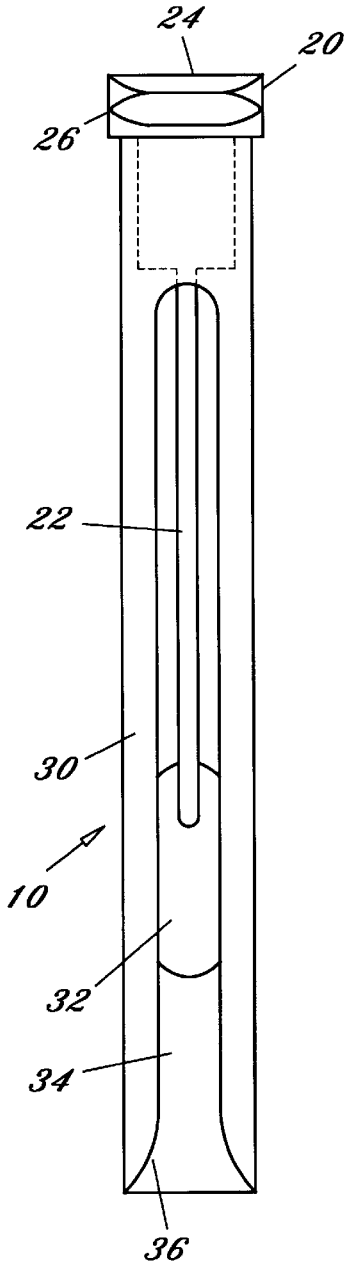
FIG. 3 is a rear view thereof.

With reference to the drawings, FIGS. 1–3 depict a preferred embodiment of a door hinge pin removal tool according to the present invention, generally referenced as 10. As best seen in FIG. 1, door hinge removal tool 10 includes a base 20 having a projecting push rod 22 and a sturdy circular barrel 30 connected to the base. Base 20 preferably defines a generally circular cross-section and defines a beveled portion 24 and a notch 26. Beveled portion 24 and notch 26 cooperate to form a structure suitable for prying off a cap as may be found on the end of a door hinge pin prior to the actual hinge pin removal.

As With reference to FIG. 2, door hinge pin removal tool 10, and particularly barrel 30 defines a window 32 specifically located on the barrel as to reveal the end portion of push rod 22. Window 32 functions to allow the user of door hinge pin removal tool to view the axial alignment of push rod 22 with a particular door hinge pin. Accordingly, window 32 increases the hinge pin removal efficiency over devices of the background art by facilitating removal on the first attempt by avoiding misalignment of the tool and particularly misalignment wherein the end of push rod 22 contacts the hinge rather than the hinge pin.

As best seen in FIG. 3, barrel 30 further defines a longitudinal slot 34 adapted to receive the door hinge structure when the tool is slidably positioned in an operative position on a door hinge. Slot 34 preferably includes a tapered end portion 36 for facilitating the engagement of the tool with a door hinge as best seen in FIGS. 1 and 3.

The instant invention has been shown and described herein in what is considered to be the most practical and preferred embodiment. It is recognized, however, that departures may be made therefrom within the scope of the invention and that obvious structural and/or functional modifications will occur to a person skilled in the art.

What I claim is:

1. A tool for use in removing door hinge pins, said tool comprising:

an elongate barrel having a first end and a second end, said barrel defining a slot originating at said first end and longitudinally extending toward said second end;

a sturdy base fixed to said barrel second end;

a push rod having a first end connected to said base and projecting axially within said barrel;

whereby a door hinge pin may be removed by slidably positioning the tool on a door hinge such that said push rod is axially aligned with the hinge pin and striking said base with a blunt object thereby causing said push rod to at least partially eject the pin from the door hinge.

2. A tool according to claim 1, wherein said barrel further defines a window for allowing a user to view alignment of said push rod with the pin of a door hinge.

3. A tool according to claim 1, wherein said slotted aperture is tapered proximate said barrel first end.

4. A tool according to claim 1, wherein said base defines a notch for use in removing caps from hinge pins.

5. A tool for use in removing door hinge pins, said tool comprising:

an elongate barrel having a first end and a second end, said barrel defining a slot originating at said first end and longitudinally extending toward said second end, said barrel further defining a window;

a sturdy base fixed to said barrel second end;

a push rod having a first end connected to said base, a mid portion projecting axially within said barrel, said push rod terminating at a second end;

said window longitudinally aligned with said push rod second end;

whereby a door hinge pin may be removed by slidably positioning the tool on a door hinge such that said push rod is axially aligned with the hinge pin and striking said base with a blunt object thereby causing said push rod to at least partially eject the pin from the door hinge.

6. A tool according to claim 5, wherein said base defines a notch for use in removing caps from hinge pins.

7. A tool according to claim 5, wherein said barrel first end defines a tapered portion forming the mouth of said notch.

* * * * *